United States Patent [19]

Stokes

[11] Patent Number: 4,484,420

[45] Date of Patent: Nov. 27, 1984

[54] FLEXIBLE ENCLOSURE FOR PROTECTING MATERIALS OR THINGS

[76] Inventor: Charlie M. Stokes, P.O. Box 1963, Auburn, Ala. 36830

[21] Appl. No.: 174,592

[22] Filed: Aug. 1, 1980

[51] Int. Cl.[3] ..... E04B 1/34

[52] U.S. Cl. ..... 52/2; 52/3

[58] Field of Search ..... 52/2, 3

[56] References Cited

U.S. PATENT DOCUMENTS

| | | | |
|---|---|---|---|
| 2,335,300 | 11/1943 | Neff | 52/2 X |
| 2,562,602 | 7/1951 | Caquot | 52/2 X |
| 2,649,101 | 8/1953 | Suits | 135/1 |
| 2,730,150 | 1/1956 | Wunderwald et al. | 52/2 X |
| 3,116,611 | 1/1964 | Margiloff | 52/2 X |
| 3,231,644 | 1/1966 | Chang | 52/2 X |
| 3,478,472 | 11/1969 | Kwake | 52/2 X |
| 3,539,057 | 11/1970 | Bronner | 52/2 X |
| 3,747,131 | 7/1973 | Koliomichalis | 52/2 X |
| 3,783,766 | 1/1974 | Baucher | 52/2 X |
| 3,839,832 | 10/1974 | Kastner | 52/2 |
| 3,857,209 | 12/1974 | Milliken | 52/2 |
| 4,031,674 | 6/1977 | Rand | 52/2 |
| 4,094,109 | 6/1978 | Prouvost | 52/2 |
| 4,121,389 | 10/1978 | Ptaszek | 52/2 |

FOREIGN PATENT DOCUMENTS

| | | | |
|---|---|---|---|
| 706503 | 1/1980 | U.S.S.R. | 52/2 |

*Primary Examiner*—Carl D. Friedman

*Attorney, Agent, or Firm*—Harvey B. Jacobson

[57] ABSTRACT

A flexible enclosure associated with a surface and materials or things oriented within the enclosure with the enclosure being arranged in a plurality of embodiments for protecting materials or things enclosed thereby.

3 Claims, 7 Drawing Figures

FLEXIBLE ENCLOSURE FOR PROTECTING MATERIALS OR THINGS

BACKGROUND OF THE INVENTION

1. Field of the Invention

The present invention generally relates to a flexible enclosure for protecting materials or things enclosed thereby with various embodiments of the enclosure including the support of the enclosure from a surface to prevent undue force or weight being applied thereto that would damage or prevent the enclosure from serving the purpose for which it was designed and which can be gas supported for orienting the enclosure in desired relationship to the materials or things enclosed thereby.

2. Description of the Prior Art

Various prior U.S. patents, as discussed briefly hereinafter, disclose enclosures and containers for protecting materials and things received therein. U.S. Pat. No. 1,622,787, issued Mar. 29, 1927, to Horton, discloses a container generally in the form of a metal container which is liquid and gas proof and provided with a specific shape arrangement. U.S. Pat. No. 2,649,101, issued Aug. 18, 1953, to Suits, discloses a double-walled insulated dome structure. U.S. Pat. No. 2,754,836, issued July 17, 1956, to Darby, discloses a flexible enclosure supported by collapsible tubes so that when they are filled with fluid under pressure, the collapsible tubes will support the collapsible enclosure. U.S. Pat. No. 2,910,994, issued Nov. 3, 1959, to Joy, discloses a flexible building or enclosure requiring continuous input of air into the interior thereof with a contour tube along the bottom of the walls with the contour tube being independently inflatable. U.S. Pat. No. 2,915,074, issued Dec. 1, 1959, to Cameto, discloses a patient treatment tent or enclosure utilizing a frame to support a tent or drape. U.S. Pat. No. 3,106,772, issued Oct. 15, 1963, to Holcombe, discloses a lifting bag in the form of a flexible member which can be used to elevate structural arrangements which are assembled at ground level. U.S. Pat. No. 3,166,799, issued Jan. 26, 1965, to Birnkrant, discloses inflatable furniture items associated with a unique building wall to facilitate inflation and deflation thereof. U.S. Pat. No. 3,229,429, issued Jan. 18, 1966, to Conrad, discloses an interior structure for a room or enclosure to render conversations inaudible to the outside and is particularly adapted for use as a conference room, or the like. U.S. Pat. No. 4,026,286, issued May 31, 1977, to Trexler discloses a flexible tent or enclosure suspended from a frame to provide an isolated environment for a patient, or the like.

SUMMARY OF THE INVENTION

An object of the present invention is to provide a flexible enclosure for protecting materials, assisting in controlling processes and the like which is adapted to rest on a surface to prevent undue force or weight that would damage the enclosure or prevent the enclosure from serving the purpose for which it is designed.

Another object of the invention is to provide a flexible material enclosure which is gas supported for enclosing materials or things therein with the enclosure permitting the material or things therein to rest on the angle of repose or recline of the materials or things with the base or bottom of the materials or things enclosed within the enclosure not exceeding the width or other dimensional characteristics of the bottom of the enclosure.

A further object of the invention is to provide a flexible enclosure with the base or sides thereof sealed to the surface or structure forming part of the enclosure with the materials or things within the enclosure being capable of resting on the structure that is part of the enclosure.

The present invention can be arranged in various structures and modes. In one arrangement, the flexible material enclosure can be completely enclosed by a structure. In another arrangement, one flexible material enclosure can be placed over another with the additional enclosure being capable of assisting in controlling the enviroment that surround the flexible material enclosure. Gases can be added to or removed from the flexible material enclosure and materials or things may be added to or removed from the flexible material enclosure and structures may be constructed inside the flexible material enclosure and various processes may be performed inside of the flexible material enclosure. In another arrangement, the flexible material enclosure can rest on the materials or things that are stored in it when the gases are removed from it. When the gas supported flexible material enclosure is filled with materials or things, the gases can be removed to permit the flexible material enclosure to collapse free of the supporting gases and rest on the materials or things that are stored in the enclosure. Another use for the flexible material enclosure is in the control of the interior environment or conditions in which the materials or things are processed when they are positioned inside of the enclosure. Any products generated by or from the materials or things stored inside the flexible enclosure can be added to or removed from the enclosure as desired or as is necessary to satisfy the needs of the user.

The flexible enclosure may have openings constructed as a part of the enclosure to permit the entrance of or removal of gases, things or materials and facilities to regulate the gas pressure inside the enclosure may be a part of the enclosure. The strength characteristics of the flexible enclosure are determined by selecting flexible material that will serve the requirements of the use of the enclosure. With gas removed from the enclosure, it can be placed through small entrances in structures and gas then can be used to expand the enclosure to its full dimensions or the full dimensions of the inside of the structure, such as inside of barrels, rooms, and the like. By sterilizing the flexible enclosure, a sterile environment can be established in any room when the enclosure is placed therein and sterile gas used to expand the flexible enclosure. With this arrangement, the enclosure can be placed through small openings in various restricted areas with the restricted areas serving to restrict the expansion and support the flexible enclosure when it is filled while confined inside the restricted area.

In another variation, the flexible enclosure can be attached to a support which can be adjusted to assist in controlling the hazards of nature that may be encountered while using the enclosure with supporting surfaces supporting all or part of the flexible enclosure with various protective or stabilizing devices being added to the flexible enclosure as required by its use. The flexible enclosure assists in controlling the materials or things that can be added to or removed from the materials or things stored inside the flexible enclose with the enclosure being capable of being placed over the materials or things after they are placed in position.

Gases or other substances that are needed by or given off by operation of a process or the like that is performed inside the flexible enclosure can be added to or removed through suitable openings or facilities in the enclosure. The shape and configuration of the flexible enclosure may be varied to adopt it to permit the desired operations or processes to be conducted within the enclosure. Likewise, the thickness and weight of the material from which the enclosure is constructed can be that which will enable the enclosure to be used for its desired purpose with entrances or other access means being provided in the enclosure enabling the user to add to remove from inside the enclosure any of the materials or things required during storage, processing or similar operations inside the enclosure. The size or shape of the entrances will be such to permit the user to make desired use of the enclosure.

The materials, things or items that are placed or stored in the flexible enclosure may be supported by surfaces other than the surface of the flexible enclosure and there may a layer of the flexible enclosure between the materials or things stored or placed in the enclosure with the weight or force of these materials or things being supported by surfaces other than the flexible enclosure. When processes or operations are taking place within the flexible enclosure they may add additional forces or pressures on the surface of the flexible enclosure, but the results of these actions can be controlled to prevent damage to the surfaces of the flexible enclosure by adjusting pressure through the entrances in the enclosure. In some installations, there can be an additional cover of flexible material similar to that of the flexible enclosure to assist in controlling the environment of the flexible enclosure and the materials, things, processes, operations or items inside the flexible enclosure even when the flexible enclosure is used for the conversion of certain materials to other products.

The flexible enclosure can be attached to airtight surfaces which support the things or items covered by the enclosure. Also, the enclosure can be placed over the surface of a pit when the pit is used for a place to store liquids or the like, but the liquid should not place any pressure on the enclosure or at least that portion which is not supported by the surface of the pit. Gases can be stored in the flexible enclosure as long as they do not exert excessive pressure on the surfaces of the flexible enclosure and cause damage to it.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
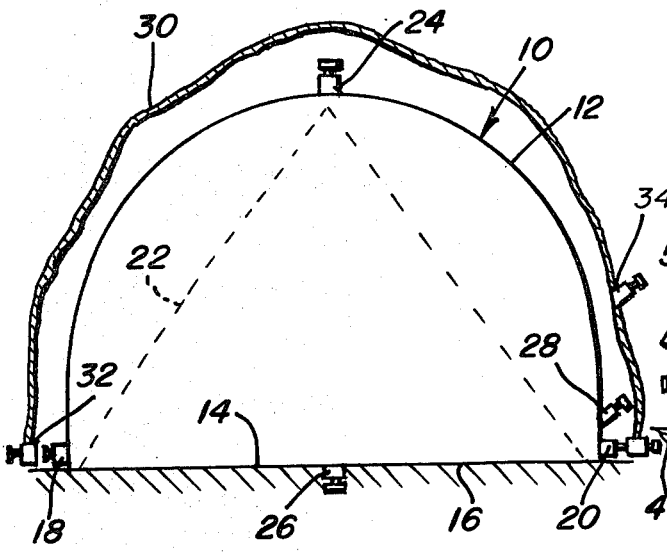
FIG. 1 illustrates schematically an enclosed system using the flexible enclosure of the present invention with a second or additional flexible enclosure being provided to assist in controlling the environment or other factors that might affect the things, materials or other conditions inside the original flexible enclosure.

Referring now specifically to FIG. 1 of the drawings, the flexible enclosure is generally designated by the numeral 10 and includes a main body portion 12 which may be dome shaped or the like and a bottom portion 14 which may be flat or of any other configuration and which is adapted to rest on a supporting surface 16 which may be in the form of the ground or any other supporting surface. The enclosure 10 is supported by gases, such as air, or other gases, that enters or is pumped into the enclosure 10 through an entrance 18 and the pressure can be regulated by suitable regulating devices associated with the entrance 18. A similar entrance 20 may be provided in the enclosure 10 opposite to the entrance 18 or at other locations on the enclosure and any conventional regulating device may be provided for controlling the internal pressure of the gases or air introduced into the enclosure 10 and various types of fans, pumps, and the like, may be employed to induce flow of gases or air into the enclosure 10. Material 22 may be introduced into the enclosure 10 through entrance 24 at the apex or dome of the enclosure or at other locations on the enclosure and may be removed therefrom or introduced thereinto through entrances 26 and 28 located at optional positions on the enclosure. The dotted line illustration of the material within the enclosure 10 indicates that the diameter of the enclosure and the diameter of the material or width of the thing 22 in the enclosure is substantially the same while the height of the enclosure 10 and the height of the material is substantially the same although the dimensions of the material or thing are always slightly less than the dimensions of the enclosure to keep the pressure of the materials or things stored inside the enclosure off the sides of the enclosure. The materials or things 22 within the enclosure 10 are resting on the natural angle of recline of these materials or things and since the width or diameter of the materials or things resting on the natural angle of recline is controlled by the height of them, the height should never be such that the width of the materials or things will exceed the width of the flexible material enclosure 10. Thus, the materials or things can be stored in the flexible enclosure as long as these materials or things do not cause deteriorating action on the enclosure or put enough pressure on the sides of the enclosure to damage it.

An additional flexible enclosure 30 encompasses the enclosure 10 and serves to assist in controlling the environment or other factors that might affect the materials, things or conditions inside the enclosure 10. The additional enclosure can be placed over the original enclosure and suitable entrances 32 and 34 are provided by which conditions within the additional flexible enclosure 30 can be controlled.

Figure 2:
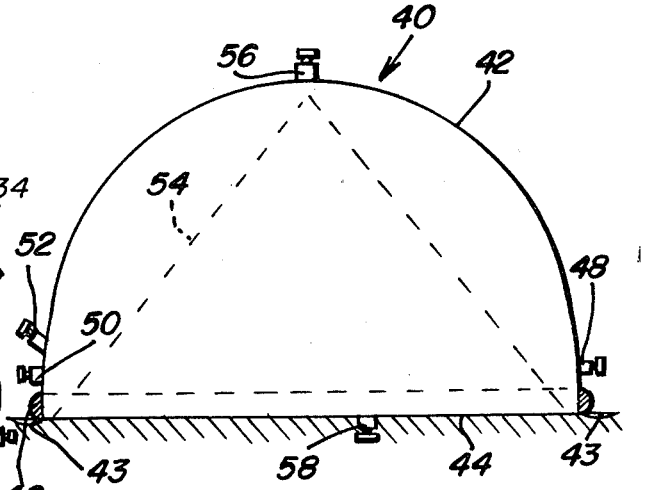
FIG. 2 is a schematic view illustrating the flexible enclosure which does not have a bottom but is sealed to a surface.

FIG. 2 illustrates another embodiment of the invention which includes a flexible enclosure generally designated by numeral 40 having a main body portion 42 similar to the body portion 12 illustrated in FIG. 1, but in this construction, the enclosure does not have a bottom similar to the bottom 14. Rather, the enclosure rests directly on a supporting surface 44 and is sealed to this surface by a structure 46 which extends around the periphery of the enclosure 40. The seal 46 retains the gases or air which support the enclosure 40 and prevent such gases from leaking between the supporting surface 44 and the body portion 42 of the enclosure 40. The shape or configuration of the supporting surface 44 is not material as long as the enclosure 40 can be sealed thereto. The gases can be placed in the enclosure through entrances 48, 50 and 52 arranged in the same manner as with the enclosure 10 and the pressure can be controlled by suitable regulating means associated with one of the entrances to the enclosure. The materials or things 54 can be placed in or removed from the enclosure through entrances 56 and 58 in the same manner as discussed in conjunction with FIG. 1. As in FIG. 1, the materials or things 54 stored in the enclosure rest on their natural angle of recline. To provide an anchoring for the enclosure 40 and a seal therefor, the lower peripheral edge of the body portion 42 may extend laterally outwardly as at 43 with the sealing member 46 being an annular weight or other structure holding the enclosure in place on the support 44 and also sealing the enclosure 40 thereto.

Figure 3:
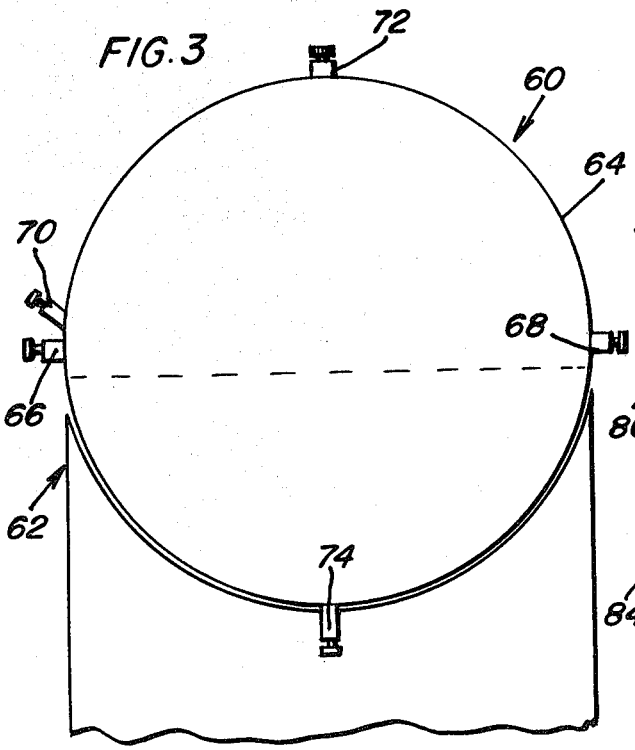
FIG. 3 illustrates a flexible enclosure placed in or on a partial or limited surface structure support.

FIG. 3 illustrates an enclosure generally designated by numeral 60 which is partially enclosed and supported by support structure 62. The enclosure 60 generally is in the form of a spherical member 64 and gases can be put into the enclosure 60 through entrances 66 and regulated at entrance 68 and the enclosure 60 may be filled or emptied with materials, things, or the like, at entrances 70, 72 or 74. The width or diameter of the materials or things in the flexible enclosure 60 should not exceed the diameter of the flexible enclosure and if liquid is placed in this facility, it should not exceed the depth of that portion of the enclosure 60 encompassed or engaged by the supporting structure 62, that is, the liquid should not exceed the level of the dotted line illustrated in FIG. 3. The shape or configuration of the partially enclosing supporting structure 62 can vary so long as it conforms with and effectively supports the enclosure 60.

Figure 4:
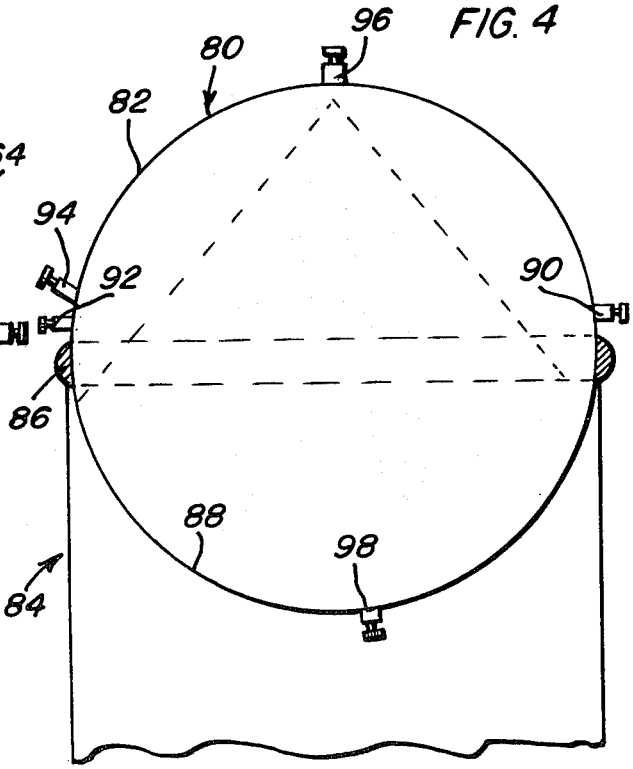
FIG. 4 illustrates schematically a flexible enclosure sealed around the top edge of a partial or limited surface structure.

FIG. 4 illustrates another embodiment of the flexible enclosure 80 which is comparable to that of FIG. 2 in that the body portion 82 is generally semi-spherical and has its lower peripheral edge sealed at the top of supporting structure 84 by a sealing arrangement 86 with the supporting structure 84 including a surface 88 for supporting materials or things placed in the enclosure 80 with the enclosure 80 not including any bottom portion such as used in FIG. 3. Thus, the supporting structure 84 combines with the flexible body portion 82 of the enclosure 80 to form a storage facility. If liquids are stored in this facility, the depth of liquid cannot exceed the top of the supporting structure 84, but materials or things that have an angle of recline can be stored therein, and also in FIG. 3, having a greater height than the horizontal center of the assembly, but the base of such materials or things should not exceed the diameter of the body portion 82 or supporting structure 84. Gases to support the flexible enclosure 80 are provided through entrances 90 and 92 and the facility can be filled or emptied through entrances 94, 96 or 98 in the same manner as in FIG. 3 and here again, the shape and configuration of the supporting structure 84 is immaterial as long as it provides a support for the material and the enclosure with the seal structure 86 being generally the same as that in FIG. 2.

Figure 5:
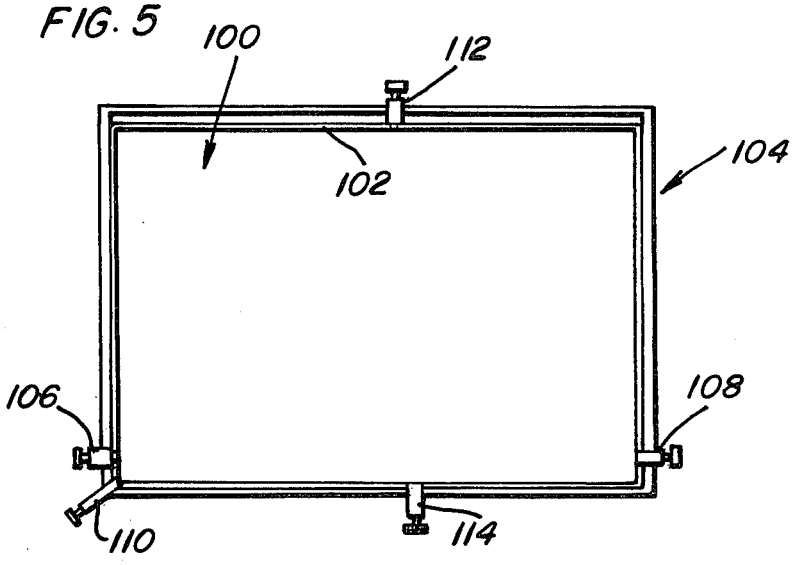
FIG. 5 illustrates schematically a structure or restricted area inside which a flexible enclosure has been placed and expanded.

FIG. 5 illustrates a flexible enclosure area generally designated by 100 in which the peripheral walls 102 are supported by a supporting structure 104 in which the shape and configuration may vary but encloses substantially all of the enclosure 100. Gases can be placed in the flexible enclosure at entrances 106 and 108 and controlled or regulated at either of those entrances while the materials or things may be placed in the enclosure through entrances 110, 112 or 114, thus enabling entry and exit of gases, regulation of the pressure and entrance and exit of materials or things in the same manner as in the other embodiments of the invention. In this arrangement, the diameter and height of the enclosure 100 can be equal to but not larger than the supporting structure 104. The width and height of the materials or things stored in the enclosure 100 should not substantially exceed the dimensions of structure 104. Materials or things that rest on the natural angle of recline can be stored or placed in the flexible enclosure 100 as long as these materials or things do not put enough pressure on the walls or sides of the flexible enclosure to damage the walls or sides and any materials or things that will deteriorate the enclosure should not be stored in it. Thus, the supporting structure 104 provides a restricted area for the enclosure 100 and enables more flexible use of the enclosure.

Figure 6:
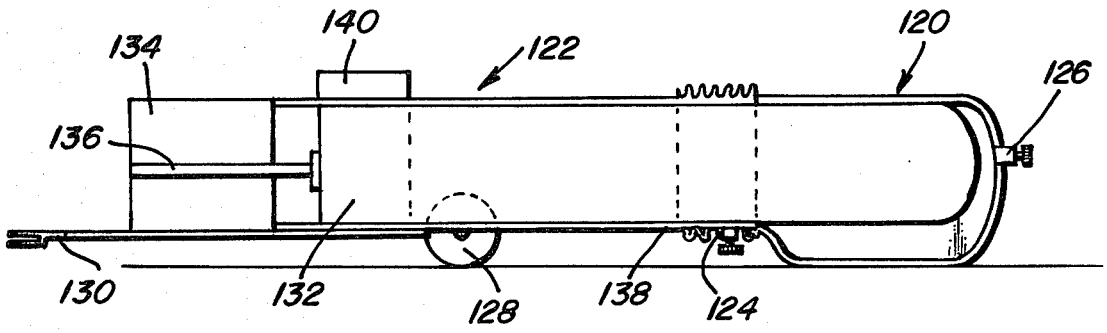
FIG. 6 illustrates schematically a flexible enclosure that is filled by a machine while the enclosure is expanded or filled with gas and the enclosure is being filled as a continuous filling operation or the enclosure can be filled by increments by the machine.

In FIG. 6, a flexible enclosure 120 is schematically illustrated but is filled either continuously or incrementally by machine 122 which is capable of being oriented stationarily or movable in increments in a manner described hereinafter. In this arrangement, gas may be introduced into the enclosure 120 at entrance 124 or other similar points and regulated at entrance 126 although this may be reversed. As illustrated, the machine 122 may be provided with supporting wheels 128 and a hitch 130 for connection with a towing machine and may be equipped with a reciprocating plunger 132 which is reciprocated by a suitable power mechanism 134 through a rod structure 136 with the power mechanism, reciprocating plunger and rod interconnecting the two being of conventional construction and, in lieu thereof, a screw-type auger or similar screw-type mechanism may be used to force material into the enclosure.

In this arrangement, a chamber 138 is provided which receives material through a filling hopper or point 140. When the flexible enclosure 120, which includes a generally cylindrical bag, is being filled continuously by the machine 122, the material that is being put into the flexible enclosure 120 flows from the chamber 138 into the enclosure 120. However, when the enclosure 120 is being filled by increments, the movable chamber 138 is filled and then is withdrawn from over the material that is used to fill the enclosure 120. After the movable chamber 138 is withdrawn, then the filler machine 122 is moved approximately the length of the movable chamber 138 and the filling operation is repeated. The plunger 132 is used to move the material which is put in the machine 122 at the filling point 140 in the machine 122 into either the enclosure 120 or into the movable filler 138. The plunger 132 is forced back and forth in machine 122 by the power device 134 and the connecting rod structure 136 and the machine 122 moves on the wheels 128 and can be pulled by the hitch on the tongue. The power source 134 to operate the plunger 132 may be on the machine 122 or may be from a source off the machine 122, such as a power take-off. The flexible enclosure 120 can be extended as the enclosure is filled and pressure in the chamber 138 forms the material into a shaped package as the material flows from the machine 122. The machine 122 moves forward after it extrudes the material from the machine 122 with the extrusion and moving procedure being repeated until the enclosure 120 is filled with the enclosure 120 resting on the ground surface or other supporting surface and the material within the enclosure will not exert forces thereon sufficient to damage the enclosure 120 since it will retain its extruded shape.

Figure 7:
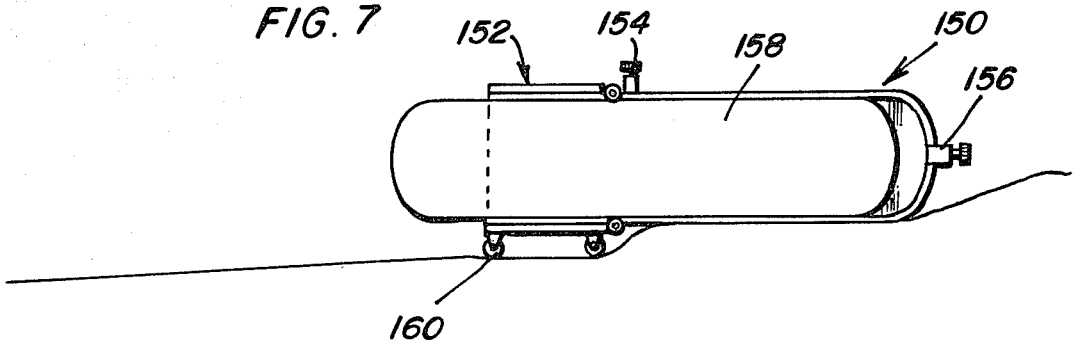
FIG. 7 is a schematic illustration of a flexible enclosure that is used to enclose material previously put in place.

FIG. 7 illustrates an enclosure 150 constructed to be placed over materials or things that are in place with the machine generally designated by numeral 152 being used in conjunction with the machine that is putting the materials or things in place and is to be covered by the flexible material enclosure 150. In this arrangement, the materials or things are placed in the flexible enclosure 150 while it is in place and is gas supported, with gas being placed into enclosure 150 at entrance 154 and regulated at entrance 156. In this arrangement, the machine 152 places the flexible material enclosure 150 over the material or thing 158 with the wheels 160 of the machine 152 enabling the machine 152 to move over the material 158 and place the enclosure 150 in place.

With the various schematic illustrations in the drawings, it will be understood that a structure completely enclosed by a flexible material enclosure or a structure that is enclosed by a combination of a flexible enclosure and partial supporting structure can be built to serve the need of individual users. However, the flexible enclosure can be completely enclosed by a structure such as illustrated in FIG. 5. The structures used to illustrate facilities covered by this invention are designed for use with liquids, gases, or solid materials, or a combination of these items can be used with this structure. The structures covered by the present invention can be filled by the materials or things that are stored in them while the flexible enclosure is supported by gases. After the facility has been filled with the desired materials or things, the gas can be removed from the facility to permit the flexible enclosure to collapse and be supported by the materials or things stored in them. However, the facility can be utilized as a storage facility with the gas still supporting the flexible enclosure. In some instances, there may be a need for gases to be used to support the flexible enclosure when the materials or things are removed from the facility. Also, the flexible enclosures may be reuseable since the flexible enclosure will normally be constructed out of lightweight, flexible, low strength materials, which are designed to offer more support than is needed to contain the gases that will be supporting them. If the user desires, a structure of this type may require the structure to be of high strength material and thus, the flexible enclosure may be constructed of high strength flexible material. The user of the flexible enclosure can add or remove from the structure things or materials as desired by him.

Various processes and operations may be controlled and augmented within the flexible enclosure, environmental conditions relative to things or materials may be modified or controlled, additional flexible enclosures may be provided over the original flexible enclosure to assist the process or operation being performed within the structure or to assist with the environmental control of the materials or things disposed within the structure. products or by-products of the processes or operations performed within the structure can be added to or removed from within the structure as desired by the user and the user is not confined as to location of use since it may be desirable to move the facility from one location to another. In certain conditions, it may be desirable to collapse the flexible material structure on the materials or things stored in the structure instead of using the gas that supports the flexible material structure. When conditions are suitable for the structure to be supported by gas, it may be filled with gas in order to fill the needs of the user. Various machines may be used in conjunction with the placement of gas in the structure and to fill the structure with things or materials and the flexible material enclosure can be placed over the materials or things after they have been placed in their desired location.

In the various embodiments of the invention, FIG. 1 is a completely enclosed system using the flexible material enclosure with places being provided in the enclosure which permits the enclosure to be filled with the desired amount of gas to expand and support the enclosure. Also, places are provided on the enclosure to permit things or materials to be added to or removed from the enclosure as desired. Pressure should be exerted by the materials or things placed in it only on the surface of the flexible material enclosure that is supported by a supporting surface.

In FIG. 2, the flexible enclosure does not have a bottom thereon with the sides or parts of the enclosure that come in contact with the surface at the bottom of the closure being sealed and fastened at the bottom surface to permit gases to be placed in the enclosure to expand and support the enclosure. Openings are provided in the system to permit gases to be added to the enclosure for operation inside, support and expansion of the enclosure. There are also openings in the enclosure to permit things or materials to be placed in the enclosure or removed from the enclosure as desired by the user.

FIG. 3 schematically illustrates the flexible enclosure placed in or on a partial or limited surface structure support with this enclosure being utilized in a manner to permit pressure of the materials or things that are enclosed in it to exert force on the enclosure only on the surface of the flexible enclosure that is supported by the partial or limited surface structure. Gases, materials or things can be added to or removed from inside the enclosure with the materials or things that are stored in this enclosure resting on the natural angle of recline as long as the materials or things do not exert pressure on the sides of the flexible enclosure that are not supported by the partial or limited surface of the support.

The arrangement in FIG. 4 is similar to FIG. 3, but the enclosure does not have a bottom structure. Rather, the bottom edge of the enclosure is sealed around the top of a partial or limited surface structure support. The flexible enclosure can be supported by gases when attached to the partial or limited surface structure and the things or materials placed in the enclosure should exert pressure only on the partial or limited surface structure when in use and openings are provided to permit the addition of or removal from the enclosure of gases, materials and things.

The enclosure in FIG. 5 includes a structure into which the enclosure may be placed. The shape or configuration of the structure to hold the flexible enclosure is not material as long as it will permit the flexible enclosure to serve the purpose or permit the desired process to be performed in it and permit the enclosure to be used in it. Openings are provided in the flexible enclosure and structure to permit gases, things or materials to be added to or removed from it. The flexible enclosure can be attached to the structure by adhesives or fasteners and the gases can be removed from the flexible enclosure or the enclosure can fit freely within the enclosing structure.

In FIG. 6, the flexible enclosure is filled by a machine while the enclosure is expanded or filled with air as the enclosure is being filled with the enclosure capable of being filled by the machine as a continuous filling operation or as an incremental filling operation. In FIG. 7, the flexible enclosure is employed to enclose a material that has previously been put in place. The material can be resting on the angle of recline for the material or the material can be preformed and the flexible enclosure can be placed over the material. The machine for placing the flexible enclosure over the material can be incorporated or used in conjunction with a machine that is placing the material in place and, at the same time, place the flexible enclosure over the material. Also, the materials or things can be placed in the flexible enclosure after the enclosure is put in place. The additional flexible enclosure, such as shown in FIG. 1, placed over the original enclosure will be larger than the original enclosure and the additional enclosure can be supported by gas that is independent of the gases that support the original enclosure. This additional enclosure will be helpful in assisting and controlling the environment that is inside and outside the original enclosure since gases can be circulated in the space between the two enclosures. The amount of space between the two enclosures can be that space needed by a user to serve those needs derived from his particular use. When desired, the gases can be removed from the flexible enclosure so that it will be permitted to collapse and rest on the materials or things inside of it. Where the flexible enclosure is enclosed in a structure, fastening devices may be provided to secure the enclosure to the structure to permit the enclosure to be supported by the structure after the gases or part of the gases have been removed from the enclosure. When gases that are part of the natural environment associated with the materials or things put into the flexible enclosure is removed from inside the enclosure, any needed gases may be placed inside the enclosure to mix with the materials or things which are inside of it. This enables moisture and other materials to be removed from the materials or things in the flexible enclosure. While the drawings are schematic, they illustrate the function of the invention and various conventional components may be provided for placing gases in the enclosure, regulating the pressure thereof, removing gases from the enclosure, placing materials or things in the enclosure and removing materials and things from the enclosure.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is a follows:

1. A flexible enclosure for materials or things comprising an enlarged flexible body member constructed of flexible material and including an unobstructed interior forming an unobstructed enclosed space, said body member being supportable by gas and including means for filling the body member with gas and means regulating the pressure in the enclosure, said body member including means enabling placement of materials or things into the enclosure and removal of materials or things from the enclosure, and a second flexible enclosure comprising an enlarged flexible body member spaced from the first mentioned body member and in enclosing relation thereto, means filling the space between the body members with gas and means regulating the pressure in the space between the body members.

2. A flexible enclosure for materials or things comprising an enlarged flexible body member constructed of flexible material and including an unobstructed interior forming an unobstructed enclosed space, said body member being supportable by gas and including means for filling the body member with gas and means regulating the pressure in the enclosure, said body member including means enabling placement of materials or things into the enclosure and removal of materials or things from the enclosure, said body member being combined with a supporting structure which forms part of the enclosed space, said materials or things placed into the enclosure resting on an angle of recline having a predetermined maximum width, said body member being generally spherical and said supporting structure having a generally semi-spherical upper surface and having a diameter at least equal to the width of the materials or things whereby the materials or things will not exert pressure on unsupported portions of the body member.

3. A flexible enclosure for materials or things comprising an enlarged flexible body member constructed of flexible material and including an unobstructed interior forming an unobstructed enclosed space, said body member being supportable by gas and including means for filling the body member with gas and means regulating the pressure in the enclosure, said body member including means enabling placement of materials or things into the enclosure and removal of materials or things from the enclosure, and a wheeled machine for placing materials or things in the enclosure with the machine including a chamber discharging materials into the body member with the body member and machine moving continuously or incrementally in relation to each other as the body member is filled with materials form the chamber on the machine, said machine including a horizontally reciprocating plunger for discharging material into the body member during relative movement between the body member and machine.

* * * * *